US006116232A

United States Patent [19]

Valters et al.

[11] Patent Number: 6,116,232

[45] Date of Patent: Sep. 12, 2000

[54] GAS FIREPLACE INSERT

[75] Inventors: Tim Valters, Burlington; Lance O'Hearn, Markham, both of Canada

[73] Assignee: Temco Fireplace Products, Inc., Nashville, Tenn.

[21] Appl. No.: 09/290,908

[22] Filed: Apr. 12, 1999

[30] Foreign Application Priority Data

May 5, 1998 [CA] Canada ..... 2236728

[51] Int. Cl.[7] ..... F24C 3/00

[52] U.S. Cl. ..... 126/512; 126/531; 126/61; 126/83

[58] Field of Search ..... 126/512, 531, 126/523, 77, 83, 60, 61, 289, 290, 80, 81

[56] References Cited

U.S. PATENT DOCUMENTS

| | | | |
|---|---|---|---|
| 1,697,225 | 1/1929 | Cesa | 126/531 |
| 2,058,094 | 10/1936 | Merrill | 126/61 |
| 4,708,123 | 11/1987 | Strand | 126/61 |
| 5,655,514 | 8/1997 | Koward | 126/523 |

*Primary Examiner*—James C. Yeung
*Attorney, Agent, or Firm*—Alan Ruderman; Miller & Martin LLP

[57] ABSTRACT

A gas fireplace insert structure having a firebox formed to direct flue gases reaching the upper section thereof through a folded path to flow forward and upwardly and then return rearwardly to an exhaust opening, and a casing formed to provide a room air circulating path around the firebox, the circulating room air path including a folded path portion disposed within and following the fold of the flue gas path.

11 Claims, 3 Drawing Sheets

1
2
19
41
4
17
32
31
7
40
34
46
44
38
48
36
34
49
48
36

GAS FIREPLACE INSERT

FIELD OF THE INVENTION

This invention relates to gas fireplaces and particularly to gas fireplace inserts for masonry fireplaces.

BACKGROUND OF THE INVENTION

There is an increasing demand to install gas fireplace inserts into the traditional masonry fireplaces to greatly increase the heating efficiency of the fireplace for added warmth and comfort.

With a gas insert the fire is lit with the flick of a switch eliminating the need for kindling. wood or natural or synthetic logs, the struggle to start the fire, and the dirt and mess involved.

Conventional fireplace inserts comprise a firebox, a casing to provide a room air flow passage around the firebox, a heat exchanger interposed between the firebox and the chimney exhaust and located in the room air flow passage and usually a fan to circulate air taken from the room around the firebox and heat exchanger and then returned to the room.

In conventional fireplace inserts the heat exchanger is mounted on the top of the firebox to direct flue gases exiting the firebox to follow an extended heat exchanging path to transfer heat to the circulating room air before exhausting up the chimney.

The provision of the heat exchanger structure or component not only is a significant cost factor but it adds to the height of the insert which must be inserted into the limited opening of the masonry fireplace thereby restricting the height of the firebox.

It is the object of the present invention to eliminate the need for the conventional heat exchanger and the cost involved allowing increased firebox height at the while at the same time without in any way sacrificing the amount of heat transferred from the flue gases to the circulating room air.

It is a further object of the invention to provide a cleansing wash of hot flue gases across the interior front transparent closure of the firebox.

SUMMARY OF THE INVENTION

According to the invention, hot gases produced by the gas flame are led through a folded or reversing heat transfer path within the upper region of the firebox itself while circulating room air within the firebox enclosure is directed to follow a folded or reversing path within the fold of the folded or reversing hot gas heat transfer path.

More particularly, according to the invention, the rear wall ofthe firebox towards the upper region thereof is folded inwardly to adjacent the front of the firebox and then returned outwardly to the rear of the firebox below an exhaust outlet in the top of the firebox while provision is made within the casing surrounding the firebox to include a folded or reversing room air circulating path within the fold of the firebox rear wall.

More particularly, according to the preferred form ofthe invention, the folded firebox rear wall has the lower portion of the fold sloping upwardly to adjacent the front of the firebox to cause a cleansing hot flue gas flow to wash over the interior surface of the front transparent closure of the firebox while at the same time providing a tapered pocket extending into the firebox and open at the rear and the casing is provided with a deflecting plate projecting into the pocket to form the folded circulating room air flow path.

DETAILED DESCRIPTION ACCORDING TO THE PREFERRED EMBODIMENTS OF THE PRESENT INVENTION

Figure 1:
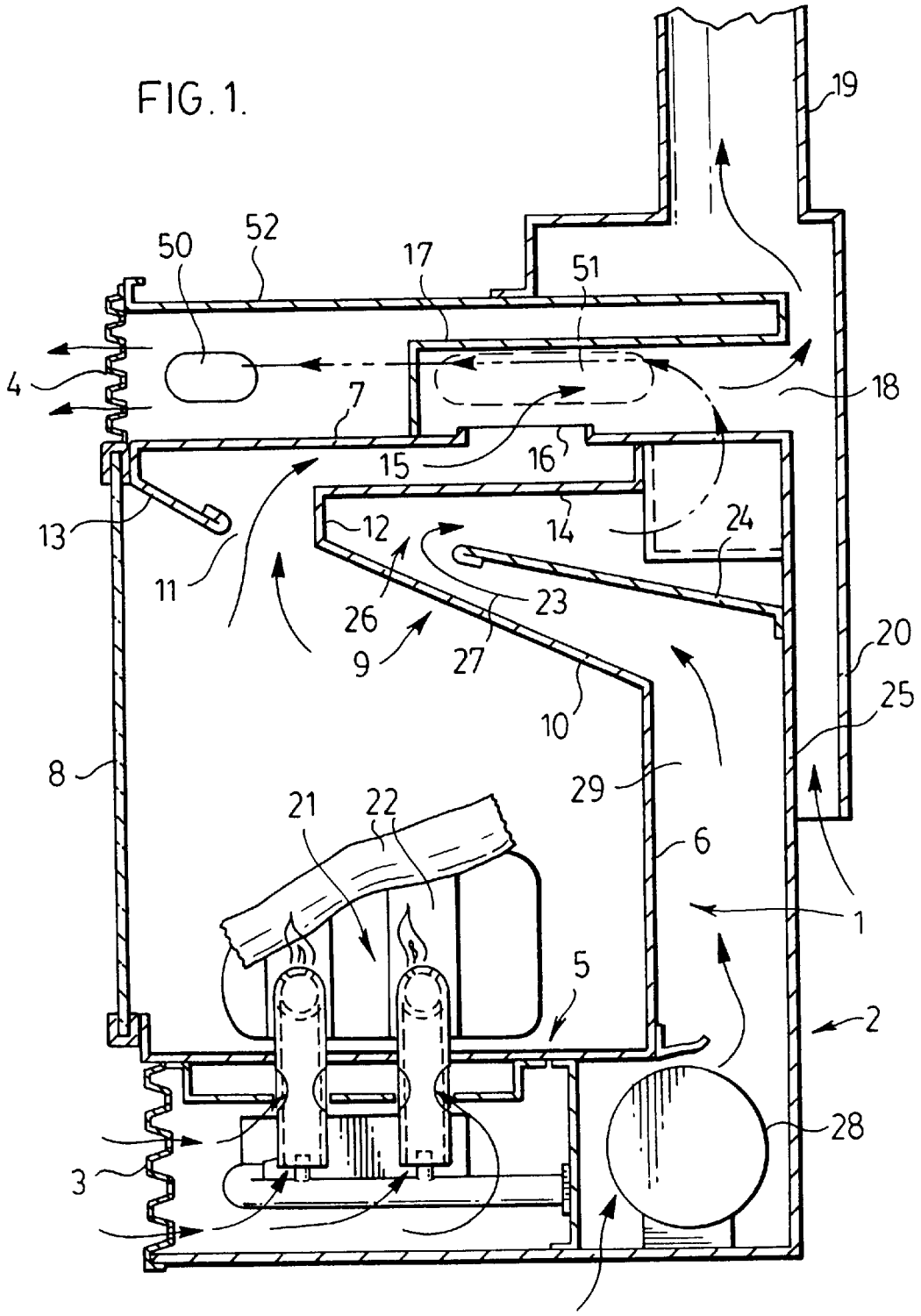
FIG. 1 is a simplified vertical sectional view taken centrally from front to back of a gas fireplace insert embodying the invention.

With reference to FIG. 1, the fireplace insert comprises a firebox generally designated at 1 enclosed by a casing 2 providing for room air flow around the firebox as hereinafter more fully explained the casing 2 being open at the front below the firebox through a lower grill 3 and above the firebox through an upper grill 4.

The firebox 1 as illustrated in FIG. 1 includes a bottom generally designated at 5, made up of a number of assembled components as hereinafter described, a rear wall 6, a top wall 7, and a transparent viewing front surface 8 which may conveniently be a glass door.

The rear wall 6 of the firebox 1 has a section designated 9 adjacent the upper region of the firebox which forms a fold which projects forward to adjacent the front surface 8 of the firebox.

This folded section 9 has a lower wall or surface 10 which projects forward and upwardly to a mouth 11 formed between a short upwardly extending wall section 12 and a flange 13 connected to the top wall 7 of the firebox.

The short wall section 12 connects the lower wall 10 of the folded firebox section with a return wall 14 which is spaced below the top wall 7 and defines therewith a flue gas passage 15 leading to an exhaust opening 16 at the rear of the fireplace top wall 7.

A collector box 17 is mounted over the exhaust outlet 16 and connects through an outlet 18 of the casing 2 with the chimney 19. An air dilution pipe 20 feeds dilution air to join the exiting flue gases as they are drawn up the chimney 19.

A gas fired burner unit generally designated at 21 with associated logs 22 is mounted at the bottom of the firebox to provide a realistic fire of burning logs.

The folded section 9 of the rear wall defines a forward extending and tapered pocket 23 which is open at the rear. A deflector plate 24 mounted on the rear wall 25 of the casing 2 projects into the pocket 23 to provide a folded room air path indicated at 26 through which a substantial portion ofthe room air designated by the arrows 27 is delivered by a blower or fan 28. The blower fan draws in room air through the lower grill 3 and delivers a large volume up the passage 29 between the casing rear wall 25 and the back of the firebox. This volume of air is then directed through the folded room air path 26 before being delivered to flow over the top of the firebox and out the upper grill 4.

This volume of circulating room air is thus caused to travel over the upper side of the lower wall 10 of the folded firebox rear wall section 9 and then against the underside of the top wall 14 of the folded rear wall section 9, that is, over an extended heat transfer path, before escaping between the back of the casing 2 and the back of the casing 2 around the collector box 17 and out the upper grill 4.

By the arrangement of providing folded section 9 of the firebox rear wall and projecting the deflector plate 24 into the pocket 23 formed by the folded rear wall firebox section 9 an efficient heat exchange between the hot flue gases and the circulating room air is effected without the requirement of a separate heat exchanger.

In addition to providing the heat exchange function described above, the forwardly folded section 9 of the firebox rear wall assists in directing the hot gases formed which contain minimal particulate material to wash over the transparent front viewing wall or door 8 of the firebox to maintain it in a clean condition.

Figure 2:
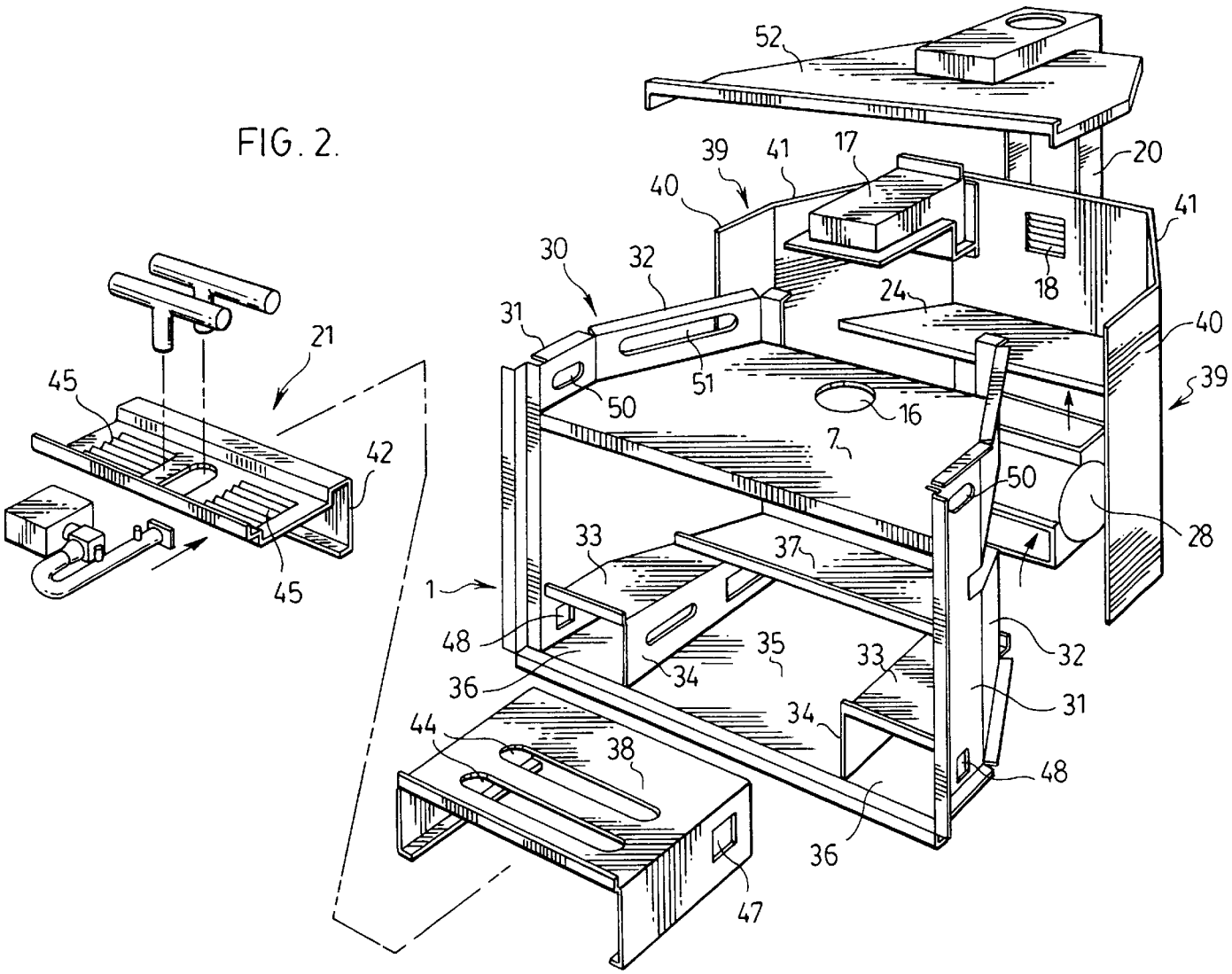
FIG. 2 is an exploded perspective view showing the various component parts ready to be assembled to form the fireplace insert illustrated in FIG. 1.

Referring now to FIG. 2, it will be seen that the side walls of the firebox 1 generally designated at 30 have parallel front portions 31 and rear portions 32 which are canted inwardly toward each other to provide a rearward taper to the firebox.

The bottom 5 of the firebox is formed by the upper surfaces 33 of two spaced right angular members 34 mounted on the bottom wall 35 of the casing 2.

The members 34 are mounted parallel to each other while their upper surfaces are shaped to conform to the firebox sidewalls 30.

These members 34 define with the sidewalls 30 inlet air flow passages 36.

A plate 37 bridging across between the members 34 defines the rear of the firebox bottom wall 5 while a mounting channel 38 adapted to fit between the members 34 forms a support for the burner unit generally designated at 21.

The side walls 39 of (be casing 2 are shaped to correspond to those of the firebox and have spaced parallel forward sections 40 and rearward inwardly canted sections 41 which taper to the rear wall 25 of the casing.

Figure 3:
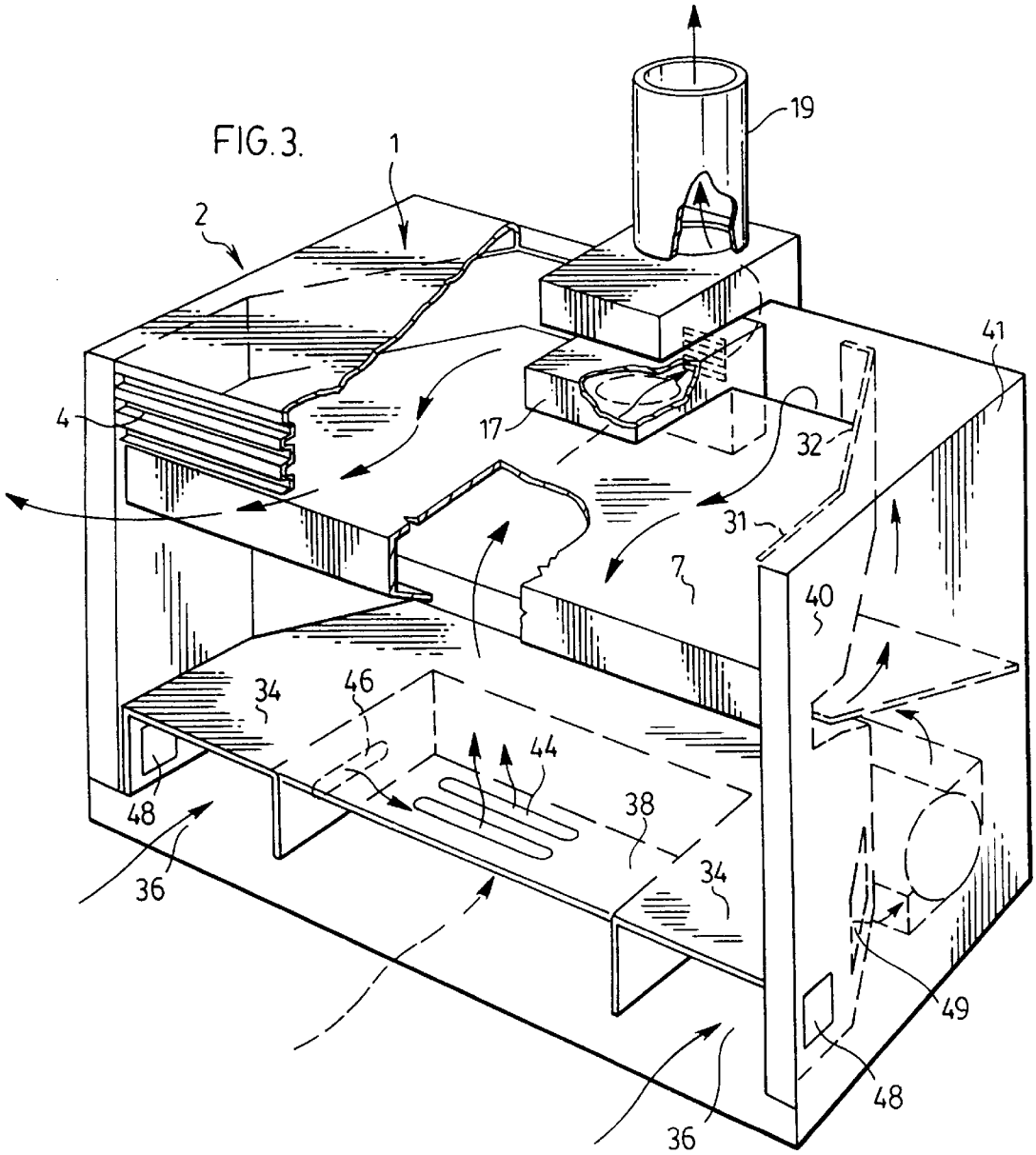
FIG. 3 is a partially broken away perspective view of the assembled components of FIG. 2 illustrating the combustion air and room air flow paths.

As illustrated in FIG. 3, the action of the blower 28 is to draw room air inwardly through the air inlet passages 36 provided underneath the members 34 at each side of the firebox. This air flowing through the passages 36 can flow through into the rear of the casing 2 while a depending flange 42 of the burner unit mount 43 (FIG. 2) blocks rearward air flow beneath the channel 38. Slots 44 in the channel 38 however allow combustion air to enter beneath the channel and then flow upwardly to support combustion of the burner unit 21 which, as the hot gases formed on combustion flow to the chimney 19, will draw the air upwardly through the grill sections 45 of the burner unit mount 43 and through the slots 44 to maintain combustion.

To assist in providing combustion air flow, the bottom support members 34 are provided with slots 46 allowing air being drawn through the tapered passages 36 to spill inwardly through openings 47 provided in the legs of the channel.

To provide air flow in contact with the side walls 30 of the firebox 1, these side walls 30 are provided with openings 48 adjacent the bottom of the parallel sections 31 which allow air drawn inwardly through the passages 36 to spill outwardly between these portions ofthe firebox and the casing sections 40.

Other openings 49 (FIG. 3) are provided in the side wall portions 32 of the firebox to allow air to flow outwardly from the passages 36 to between these portions of the firebox side wall and the casing side wall sections 41.

As illustrated in FIGS. 2 and 3, the side wall portions 31 and 32 of the firebox project above the top wall 7 of the firebox and are provided with openings 50 and 51 respectively located above the firebox top wall 7 to allow the air flowing around the sides of the firebox to be returned to the air flow beneath the coaxial top wall 52 and out through the upper grill 4.

It will be understood that the circulating air will be exposed to the heat transferred through the side walls of the firebox in addition to the transfer which takes place in the folded room air path 26 to provide high efficiency heating of the circulating air without the need of a separate heat exchanger providing a significant cost saving and ease of manufacture. Further, by folding the rear wall of the firebox causing a wash of hot gases over the front viewing surface 8, this surface will be constantly cleaned during operation of the fireplace.

It will be understood that variations in the detail may be made without departing from the scope of the appended claims.

The embodiments of the invention in which an exclusive property or privilege is claimed are defined as follows:

1. A gas fireplace insert structure comprising: a firebox having an upper section including a wall formed with a fold therein to direct flue gases through a folded path to direct said flue gasses forwardly and upwardly and then to return rearwardly along said wall to an exhaust opening above said fold; a casing surrounding said firebox forming a room air circulating path around said firebox between said firebox and said casing, said casing including a deflector to form the room air circulating path into a folded path portion disposed within and following the fold of said flue gas path, and said room air circulating path directing a circulating air flow from a bottom portion towards a top portion of said fireplace insert.

2. A gas fireplace insert structure as claimed in claim 1 having blower means between said casing and said firebox for circulating room air around said firebox including through said room air circulating path from the bottom towards the top of said fireplace insert.

3. A gas fireplace insert structure comprising a firebox having a pocket formation extending into the rear thereof adjacent the top thereof to direct flue gases forwardly as well as upwardly and then rearwardly to an exhaust opening, and a casing for said firebox to provide a room air circulating path around said box, a deflector plate carried by said casing and disposed in said room air circulating path and projecting into said firebox pocket to direct room air to flow around said deflector plate into and then out of said pocket, and blower means for circulating room air through said circulating path from the bottom towards the top of said fireplace insert.

4. A gas fireplace insert structure as claimed in claim 3 in which said pocket formation has a lower surface extending forwardly and upwardly joined to a rearwardly extending top return surface.

5. A gas fireplace insert structure having a firebox formed to direct flue gases in a folded path to flow forwardly and upwardly and to then return rearwardly to an exhaust opening, a firebox enclosure formed to provide a room air circulating path around said firebox, deflector means in said room air circulating path to direct room air on a folded path within said folded flue gas path, air circulating means for circulating room air through said room air circulating path.

6. A gas fireplace insert structure comprising a firebox having a bottom wall, side walls, a top wall, a front viewing closure and a rear wall, said top wall having a flue gas outlet theme adjacent said rear wall, said rear wall having a forwardly projecting folded section adjacent said top wall, said folded section having a forwardly extending upwardly sloping lower wall portion joined adjacent to said front viewing closure to a rearwardly extending top wall portion defining with said firebox top wall a passage leading to said flue gas outlet, said folded section defining a tapered pocket extending inwardly into said firebox and open at the rear of said firebox, a casing surrounding said firebox and providing a room air circulating path around said firebox, an air deflector plate projecting from said casing into said pocket to provide a folded air path for circulating room air to follow the upper side of said upwardly sloping lower wall portion and the underside of said rearwardly extending return wall portion of said folded firebox rear wall section.

7. A gas fireplace insert as claimed in claim 6 having blower means in said room air circulating path arranged to direct air around said firebox including through said folded room air path.

8. A gas fireplace insert as claimed in claims 6 or 7 in which said firebox is tapered towards said rear wall.

9. A gas fireplace insert as claimed in claims 6 or 7 having a flue gas collector box over said flue gas outlet for collecting flue gas for delivery to a fireplace chimney.

10. A gas fireplace insert structure comprising a firebox enclosure having a transparent front viewing area and a surrounding casing, said firebox having an exhaust opening in the top thereof, adjacent the rear thereof, said exhaust opening being in communication with an exhaust outlet in the rear of said casing, said firebox having adjacent the upper region thereof a folded rear wall section projecting inwardly to adjacent the front of said firebox to direct flue gases forwardly and then rearwardly to said exhaust opening, said insert having a combustion air flow passageway beneath the central portion of said firebox, said passageway being open to the front of said casing and in communication with the interior of said firebox, a pair of room air inlet passages beneath said firebox one on each side of said central combustion passageway, said passages being open to the front of said casing and in communication with the interior of said casing around said firebox, a first grill covering the openings to said passageway and passages, a room air discharge outlet at the front of said casing above said firebox, blower means for drawing room air in through said room air inlet passages, circulating the room air around said firebox and discharge the room air out said room air discharge outlet, a second grill covering said room air discharge outlet, and deflector means for deflecting room air circulated by and blower means to follow said firebox folded rear wall section.

11. A gas fireplace insert structure as claimed in claim 10 in which said firebox and said casing are tapered towards the rear thereof.

* * * * *